US005281000A

United States Patent [19]

Ackley

[11] Patent Number: 5,281,000

[45] Date of Patent: Jan. 25, 1994

[54] ADJUSTABLE CHAIR SUPPORT SUPPLEMENT

[75] Inventor: Robert E. Ackley, Greenville, S.C.

[73] Assignee: Span-America Medical Systems, Inc., Greenville, S.C.

[21] Appl. No.: 847,616

[22] Filed: Mar. 5, 1992

[51] Int. Cl.[5] ..... A61G 15/00

[52] U.S. Cl. ..... 297/397; 297/220

[58] Field of Search ..... 297/397, 284.4, 284.5, 297/284.7, 188, 191, 224, 229, 283, DIG. 1

[56] References Cited

U.S. PATENT DOCUMENTS

| | | | |
|---|---|---|---|
| 4,165,125 | 8/1979 | Owen | 279/220 |
| 4,725,094 | 2/1988 | Greer | 297/220 X |
| 4,877,288 | 10/1989 | Lee | 297/220 X |
| 5,010,610 | 4/1991 | Ackley | 5/481 |
| 5,079,790 | 1/1992 | Ponch | 297/DIG. 1 X |

FOREIGN PATENT DOCUMENTS

| | | | |
|---|---|---|---|
| 1472245 | 1/1967 | France | 297/397 |
| 1476493 | 6/1977 | United Kingdom | 297/188 |
| 2194883 | 3/1988 | United Kingdom | 297/397 |

*Primary Examiner*—Laurie K. Cranmer

*Attorney, Agent, or Firm*—Dority & Manning

[57] ABSTRACT

An adjustable chair support supplement has a foam material main body which is surrounded with a fabric covering and provided with straps for selected securement to the back of a chaise lounge or similar support. A fabric support pocket may be added for supporting the covered foam body to the top of a chaise lounge. The covered foam member forms a padded layer which may be selectively secured with the strap to different parts of the chaise lounge back so as to adjust supplemental user support as desired.

9 Claims, 3 Drawing Sheets

ADJUSTABLE CHAIR SUPPORT SUPPLEMENT

BACKGROUND OF THE INVENTION

The present invention generally concerns an improved chair support supplement and more specifically concerns an adjustable foam pillow which may be selectively secured on a chaise lounge or other primary support so as to adjustably supplement user support thereon.

It is generally well known to make use of various pillows of differing constructions (such as, including fabric covered foam bodies) to supplement user support, such as on a couch or chair. One group of normally small, but often bulky, pillow supplements are commonly referred to as throw pillows. On a couch or easy chair, such pillows are frequently wedged into a corner such as formed between the back and arm of the couch or chair. Then, the user's body is positioned relative both the primary support and the supplemental pillow.

In such arrangements, the throw pillow offers limited support. Additionally, a user often is frequently attempting to adjust the position of the pillow for the desired comfort.

Use of such a pillow is even more problematic and less beneficial if it is desired to support some portion of the back, or especially if it is desired to support the neck and head area. Additional difficulties encountered include the fact that the pillow itself is often positioned simply by being trapped between the user's body and the primary support. Hence, if the user moves, such as to get up from the chair or to readjust, the pillow often falls down or otherwise dislocates from the desired position.

In addition to the foregoing drawbacks, typical throw pillows, such as decorative or bulky pillows on a couch or easy chair, would not be usable in many other instances where some supplemental support is desired. For example, many kitchen chairs or other chairs at tables, have an unpadded, ladder back type construction, with which a bulky pillow could not be used. In such instances, it has been known to literally tie a pillow to the back of the chair, but such an arrangement, in general, offers no specific adjustability.

Still further problems may exist in other specific settings, such as outdoor use as may be encountered with a chaise lounge or similar. The entire disclosure (including all figures and specification description) of commonly assigned U.S. Pat. No. 5,010,610 to Ackley for "Multilayer Supplemental Support Pad" is hereby incorporated in this application by reference. The Ackley '610 patent discloses a multilayer supplemental support pad which is an ideal arrangement for supplementing the entire support surface of a chaise lounge or other similar primary support. However, such invention is not specifically intended to address providing an adjustable chair support supplement for supplementing support of a selected region of a user on a chaise lounge or other similar primary support.

SUMMARY OF THE INVENTION

The present invention recognizes and addresses various of the foregoing problems, and others, concerning adjustable chair support supplements. Thus, broadly speaking, one principal object of this invention is to provide an improved chair support supplement. More particularly, a present main object is to provide an improved adjustable chair support supplement for supplementing support of a selected region of a user on a chair, particularly on a chaise lounge or similar primary support.

It is another particular object of the present invention to provide a chair support supplement which may be adjustably secured to a chair support in alternate positions and in alternate manners, so as to maximize conformance with the user's selection. Hence, it is another general object to provide an improved apparatus in accordance with this invention which specifically permits the user to select and adjust, i.e., reselect, a chair back position to which padded supplementation will be provided, for desirably supporting a corresponding region of the user's body.

Still a further more particular object is to provide such an improved apparatus which alternately may support objects (such as suntan lotion, TV remote control, or others) which may be temporarily in use by the chair occupant and otherwise desirably stored nearby.

It is a still further object to provide such an improved apparatus which is relatively light weight, durable, and comprised of materials and fabrics which are washable.

Additional objects and advantages of the invention are set forth or will be apparent to those of ordinary skill in the art from the detailed description which follows. Also, it should be further appreciated that modifications and variations to the specifically illustrated and discussed features hereof may be practiced in various embodiments and uses of this invention without departing from the spirit and scope thereof, by virtue of present reference thereto. Such variations may include, but are not limited to, substitution of equivalents means and features or materials for those shown or discussed, and the functional or positioned reversal of various parts, features, or the like.

Still further, it is to be understood that different embodiments, as well as different presently preferred embodiments, of this invention may include various combinations or configurations of presently disclosed features, or their equivalents (including combinations of features or configurations thereof not expressly shown in the figures or stated in the detailed description). One exemplary such embodiment of the present invention relates to an adjustable chair support supplement comprising a center body member, a fabric covering, and specific strap means. Such center body member preferably comprises generally a layer of foam material, while the fabric covering thereof is received about the center body member so as to form a covered foam body. The specific strap means are secured thereto for removably securing such covered foam body to the back of a chair in a selected position thereon so as to supplement support of a selected region of a user on such chair.

Another present exemplary embodiment concerns a padded removable foam pillow for adjustably supplementing user support on a chaise lounge or similar primary support. Such embodiment comprises a generally rectangular main body comprised of a foam layer having a thickness generally in a range from about ½ of an inch to about 2 inches. Such embodiment further includes a fabric covering received about the main body so as to substantially encase same. Also included are respective first and second securement means. The first securement means preferably includes a fabric member secured to the main body for removably supporting such main body on the top of a chaise lounge back. The second securement means includes a strap attached generally at opposite longitudinal ends of the main body for removably supporting the main body at a selected region of the chaise lounge back. With the foregoing embodiment, a user may select between the first and second securement means so as to adjustably supplement user support as desired.

Those of ordinary skill in the art will better appreciate features and aspects of such embodiments and others upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
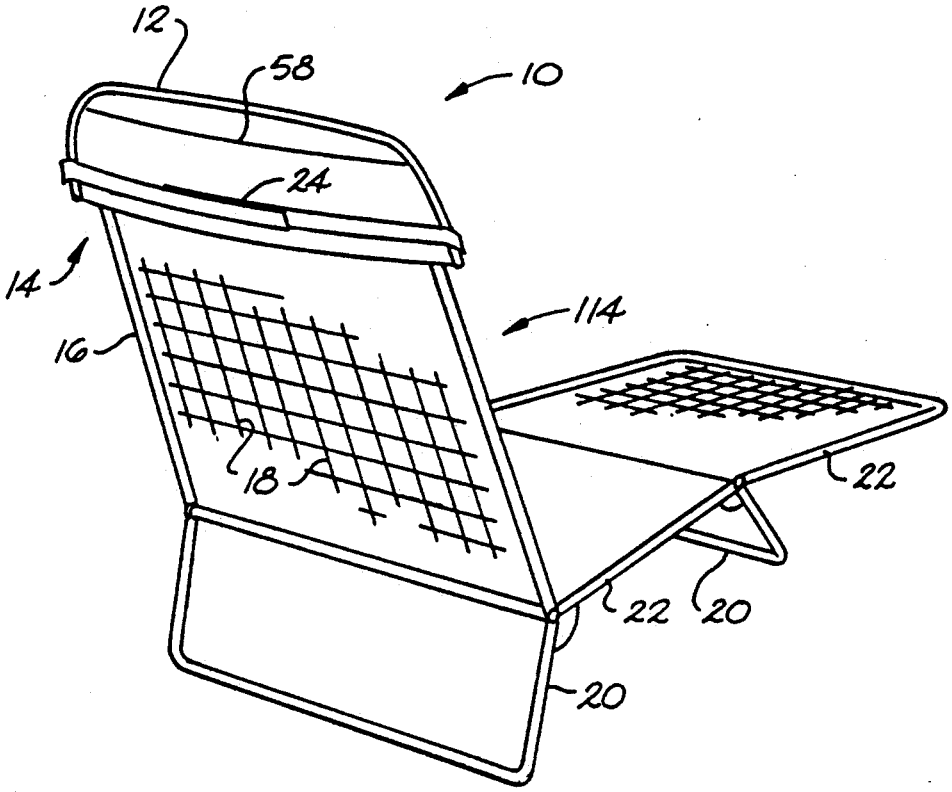
FIG. 1 is a generally rear perspective view of a first exemplary embodiment of the present invention illustrating use thereof with an exemplary conventional chaise lounge.

Repeat use of reference characters throughout the present specification and appended drawings is intended to represent same or analogous features or elements of the invention.

DETAILED DESCRIPTION OF THE PREFERRED EMBODIMENTS

FIGS. 1 through 4 illustrate a first exemplary embodiment (generally 10) of an adjustable chair support supplement or a padded removable foam pillow in accordance with the present invention. More specifically, chair support supplement 10 includes a covered foam body 12 which is illustrated in FIG. 1 as being supported on the top 14 of a chaise lounge back 16. As well understood by those of ordinary skill in the art, back 16 is typically a straight member comprised of a rigid frame with webbing 18 or the like, all of which may be placed at a user desired angle relative the support legs 20 and remaining frame elements 22. See the further detailed discussion of a conventional chaise lounge 10 as set forth in the incorporated by reference U.S. Pat. No. 5,010,610.

The present adjustable chair support supplement 10 preferably includes strap means 24 secured to covered foam body 12, for removably securing the covered foam body to the back 16 of the chaise lounge. However such strap means preferably comprise second securement means, which may be alternatively (i.e., optionally) used with or without first securement means, generally 26, as discussed hereinafter.

Figure 3:
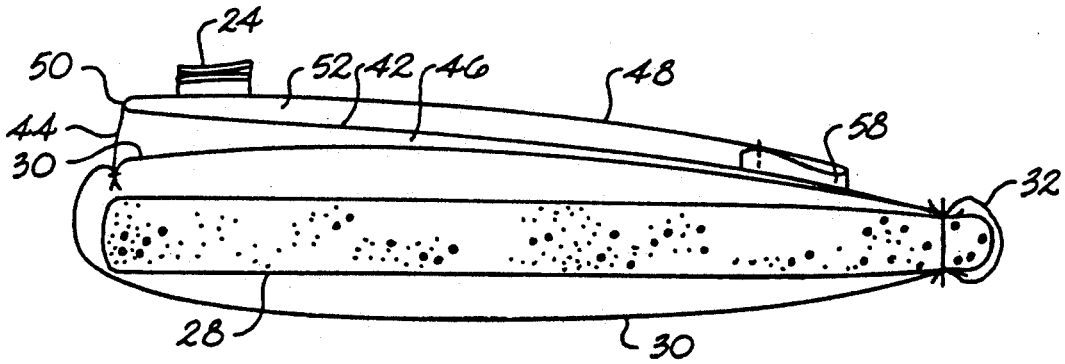
FIG. 3 is an enlarged cross-sectional view of the exemplary embodiment of present FIG. 2, taken along the sectional line 3—3' illustrated therein.
Figure 2:
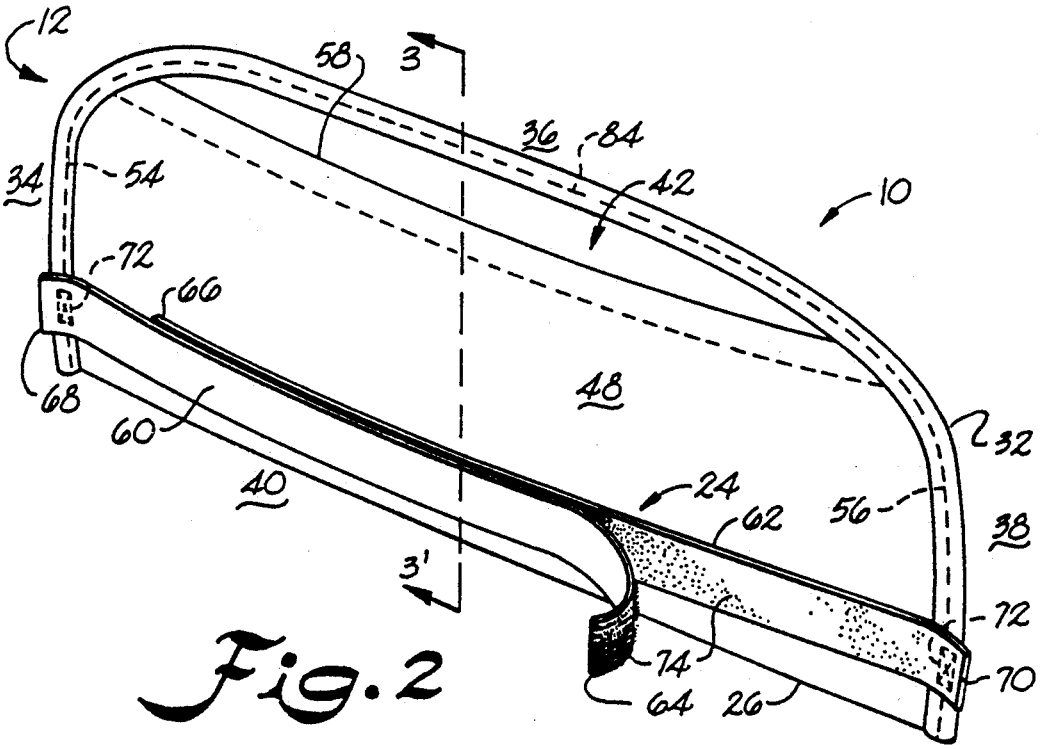
FIG. 2 is an enlarged generally rear elevational view of the exemplary embodiment represented in present FIG. 1, prior to support on a chaise lounge or similar primary support.

FIGS. 2 and 3 illustrate in greater detail the construction of the exemplary embodiment 10 represented generally in FIG. 1. More specifically, FIG. 2 is an enlarged, generally rear elevational view of supplement 10, and FIG. 3 is a cross-sectional view of the FIG. 2 structure taken along sectional line 3—3' therein.

A center body member 28 (FIG. 3) comprises generally a layer of foam material. A fabric covering 30 is received about center body member 28, and together collectively they may be referred to as the covered foam body 12. Such fabric covering preferably fully encloses the center body member, and may comprise various washable materials, as discussed hereinafter. Also, as is readily apparent from the specification, fabric covering 30 may comprise different layers (also constituting different materials) held together by stitching, gluing, or the like.

As further illustrated an edging 32 may be provided. Because the covered foam body 12 is preferably generally rectangular, it has generally four edge regions 34, 36, 38, and 40. When used, edging 32 preferably extends along three of such edge regions (34, 36, and 38) since such edge regions are generally turned upwardly when received in a selected position such as represented in present FIG. 1. During such usage, it should be apparent to one of ordinary skill in the art that the edge region 40 remains relatively down turned.

As otherwise illustrated in the figures, first securement means 26 may comprise a further fabric member 42 secured through stitching or the like along such three edge regions 34, 36, and 38, but not the relatively down turned edge region 40. Such an arrangement forms an opening 44 projected towards the longitudinal side edge 40 and into which the top 14 of chaise lounge back 16 may be received. As shown in FIG. 3, opening 44 leads into a channel 46 which is formed between fabric member 42 and the covered foam body 12 (or fabric covering 30 thereof). It is into such channel 46 that the top 14 of the chaise lounge progresses and is received after passing through opening 44.

A further upturned portion may be formed, preferably with an integral continuation 48 of the fabric member 42. With such an arrangement, the folded area 50 serves to enclose a "bottom" portion of channel 52 (FIG. 3) the sides of which may be enclosed by the same lateral stitching 54 and 56 which retains fabric covering 30, the edging 32, and the fabric member 42. Of course, such stitching 54 and 56 is generally representative for purposes of example only, and other suitable means of securing, such as gluing or the like, may be practiced. In addition, separate stitching or gluing may be provided in multiple passes as the adjustable chair support supplement 10 is fabricated. If desired, fabric portion 48 may comprise a separate member which is otherwise secured relative member 42.

As represented in present FIGS. 1 through 3, the upturned pocket portion results in an opening 58 (facing generally in the opposite direction from that of opening 44) leading to channel 52, and through which various objects may be received for storage or the like. For example, suntan lotion, sunglasses, hotel room keys, or the like may be secured in such pouch whenever it is used outside, such as on the back of a chaise lounge, as in present exemplary FIG. 1. On the other hand, and particularly when used in other embodiments or in other settings, such as indoors on the back of a regular chair, various objects such as remote controls for a TV, VCR, or the like, as well as program guides or other materials, may be retained in such pouch for easy access by the user.

FIG. 2 illustrates in greater detail strap means 24 in accordance with one exemplary embodiment thereof per the present invention. More specifically, such strap means may comprise a pair of straps 60 and 62 having respective free ends 64 and 66. As illustrated, the base of each such strap may be attached at generally opposite longitudinal ends 68 and 70 of the main body of chair support supplement 10. Attachment may be through stitching 72, gluing, or other suitable means. Whenever two such straps 60 and 62 are utilized, they may be mutually secured in various fashions (as shown in FIGS. 1 and 2) so as to permit user selected positioning of the support supplement 10 on the back of a chaise lounge or similar. While snaps, metal hooks, or the like may be utilized, one preferred embodiment is to provide respective hook and loop closure members 74 on the opposing surfaces, such as Velcro brand closures.

During use of a given embodiment, such second securement means 24 may be used optionally and instead of operating the first securement means 26. In other words, a user could position support supplement 10 so that the back 16 of a chaise lounge or other primary support is passed between fabric member 48 and straps 60 and 62, instead of being inserted into channel 46 as described above. Of course, in some embodiments, the first securement means could be omitted altogether, so that in such instance the chair back would be received between the covered foam body 12 and the strap means 24. In either such case, the straps 60 and 62 would be mutually secured with adequate tightness to prevent slippage of covered foam body 12 relative the primary support.

Present FIGS. 1 through 3 also are intended as being representative of strap means comprising a single resilient strap, such as comprised of elastic material or similar. In such instance, the strap would again be attached at generally opposite longitudinal ends 68 and 70, and a user would again position support supplement 10 along the back 16 of a chaise lounge or the like, by simply sliding the entire apparatus up and down to the desired position. First securement means 26 may be optionally provided, as discussed above. An upturned pouch channel 58 or similar may also be provided, with or without inclusion of first securement means 26. If desired, a degree of elasticity may also be used with two-strap arrangements, such as straps 60 and 62. Still further, such as larger embodiments, more than one strap means 24 may be practiced.

Figure 4:
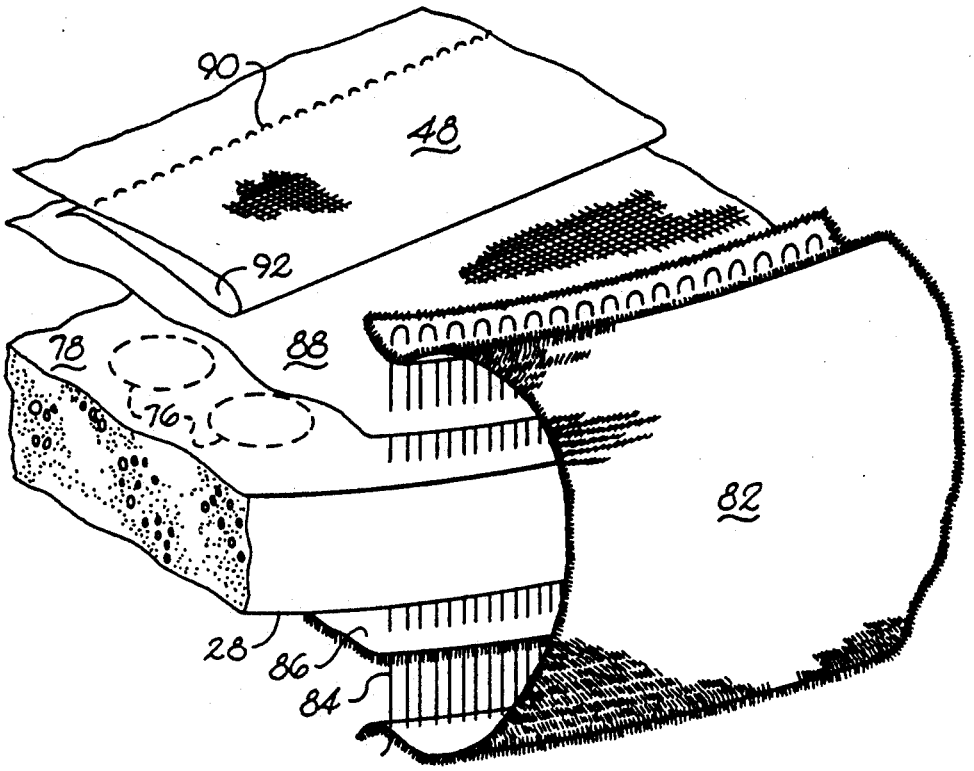
FIG. 4 is a still further enlarged and partial view in explosion of the present exemplary embodiment of FIGS. 1 through and 3.

Exploded FIG. 4 illustrates additional present features of a portion of the exemplary embodiment of present FIGS. 1 through 3. More specifically, a foam member 28 may include convolutions 76 (shown in dotted line) in at least one surface thereof. Alternatively, other surface treatments may be provided. In this invention, the represented convolutions 76 (similar to those of 132 of U.S. Pat. No. 5,010,610), may be regarded as included in a generally flat surface comprising the planar surface 78 of generally planar member 28. Other generally planar surfaces which are not generally flat may also comprise given embodiments of the subject invention.

As previously discussed, a fabric edging 82 may be provided about selected edge regions or peripheral portions of the center body member 28, and variously secured with stitching 84. Such stitching may simultaneously secure one part 86 of the fabric covering 30, as well as an opposite part 88 thereof. In such manner, the center body member 28 is preferably fully enclosed or encased, as represented in present FIG. 3. As shown in detail in FIG. 4, additional stitching 90 may used simply to provide a turned down edge 92 for the fabric member 48.

With respect to materials, various fabrics may be utilized. In general, washable fabrics are preferred, so as to generally render the entire chair support supplement 10 washable. As examples, the fabric layer 86 (generally turned towards the body of a user to be supported, may comprise a natural material such as natural terry cloth, for desired absorption and softness characteristics. Fabric edging 82 may comprise likewise. Other materials may, of course, be practiced, including materials dissimilar from that comprising layer 86. Likewise, layer 88 may comprise other materials, such as a rubber backing, or a fast drying manmade material such as nylon or other polyesters.

In addition to the use of different materials, various patterns, choice of colors, and the like may be utilized for decorating the support supplement 10, especially fabric layers 86 and edging 82 thereof.

Figure 5:
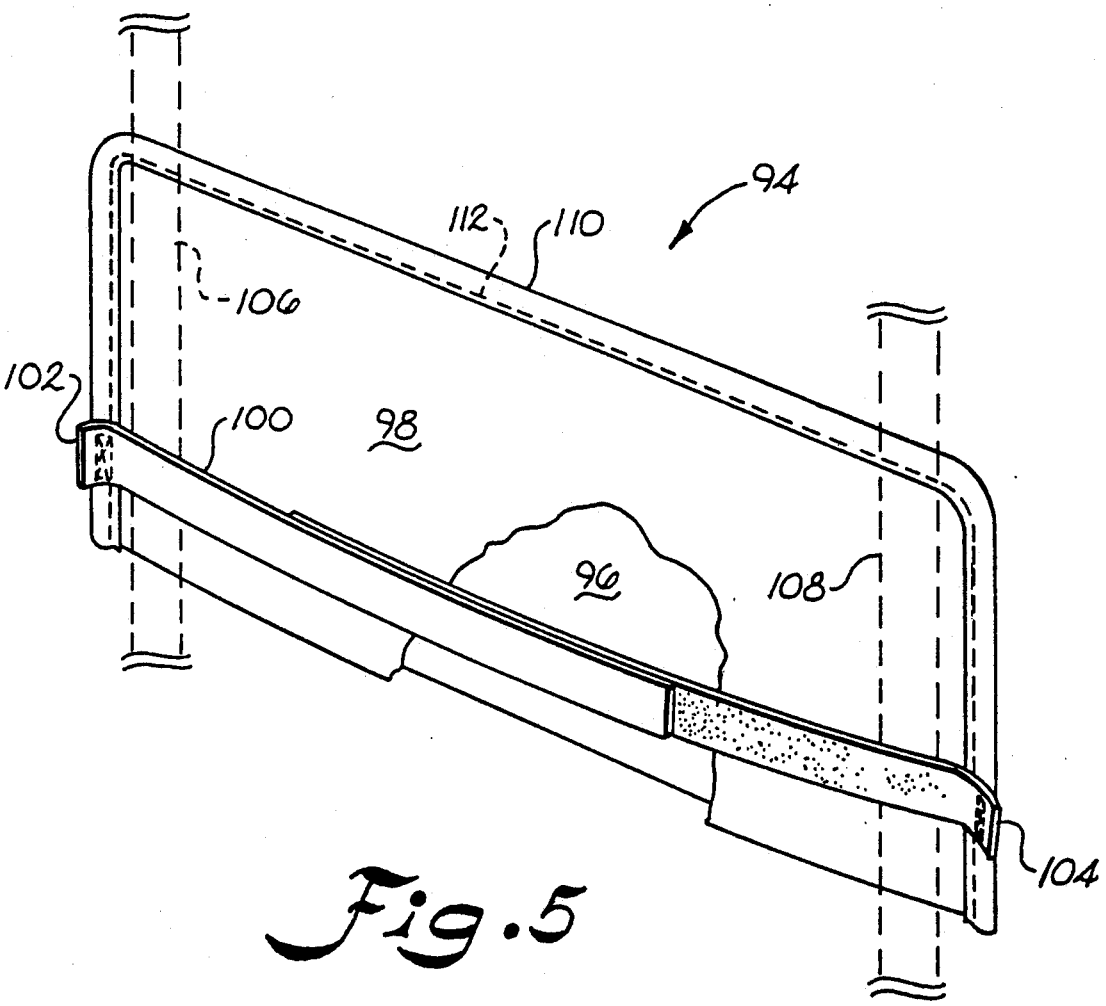
FIG. 5 is an enlarged generally rear elevational view, with partial cutaway, of an alternate exemplary embodiment in accordance with the present invention, prior to securement thereof on a primary support.

FIG. 5 illustrates a second exemplary embodiment 94 generally in accordance with the present invention. More specifically, a center body member 96 comprises generally a layer of foam material which has a fabric covering 98 received thereabout. As illustrated, the fabric covering 98 is shown in partial cutaway so as to illustrate the relative position and location of foam layer 96. A strap means 100 (preferably a pair of mutually securable straps) are secured at generally opposite longitudinal ends 102 and 104 to the covered foam body.

As shown, strap means 100 removably secure the covered foam body (foam layer 96 and fabric covering 98) to the back of a chair in a selected position thereon so as to supplement support of a selected region of a user on such chair. Exemplary chair back elements 106 and 108 are illustrated in dotted line to show the relative position thereof between the covered foam body (center body member 96 and fabric cover 98) and strap means 100. With such an embodiment, additional first securement means or pouch means of any type need not be practiced, though they may optionally be practiced if desired. Also, an edging 110 and associated stitching 112 (or gluing, etc.) therefor may be utilized. Again, such stitching may also be involved with securement of fabric cover 98 to center body member 96.

Those of ordinary skill in the art will appreciate various modifications and variations which may be practiced. For example, the exemplary embodiment of FIG. 5 illustrates a generally integral, substantially rectangular center body member 96 of foam. In such embodiment, the top edges thereof are generally squared off, while by comparison, the corresponding top edges of the embodiment of present FIGS. 1 through 4 are generally rounded even though the remaining foam body member is generally rectangular within the meaning of the present invention.

Other specific shapes may be practiced, including a slightly curved top (concave to the upper surface) such as to accommodate a person's head while providing a degree of support to the user's neck.

In addition, the generally rectangular main body comprising a foam layer may have various specific dimensions, which may differ from one embodiment to another. For example, in one exemplary embodiment the center body member preferably has a thickness of between about ½ to 2 inches. In general, it is not strictly necessary that the thickness be precisely the same over the entire foam body member, particularly if various support surfaces are other than flat (as further discussed above).

Still further, the foam (such as polyurethane foam) preferably has a density generally in a range from about 1 to about 5 pounds per cubic foot, and more preferably, within a range of about 1 to 2 pounds per cubic foot.

The generally rectangular center body member preferably comprises an integral layer of foam material, though some embodiments may involve nonintegral pieces which are glued together or otherwise mutually cooperating.

In addition to the preferred thickness range as stated above, such center body member has a width (the dimension along the axis of section line 3—3' in present FIG. 2) generally in a range of about 4 to 12 inches. The preferred length (generally along the axis perpendicular to the section line 3—3' in present FIG. 2) is generally in a range of about 18 to 30 inches.

Slightly tighter ranges on each of the above numbers would be generally preferred with respect to adjustable chair support supplements intended for use on a chaise lounge or the like. For example, an embodiment specifically for use on a chaise lounge might have a width of about 8 inches and a length of about 22 inches (inclusive of any edging) so as to cover a zone of the chaise lounge back.

As understood, for example, per present FIG. 1, the strap means 24 secure the covered foam body 12 in a selected relatively horizontal position on a chair back. If strap means 24 were being used for securement of member 12 in the exemplary arrangement of present FIG. 1 (instead of first securement means 26), the entire supplement could be relatively raised or lowered along the length of the chaise lounge back 16, as understood by those of ordinary skill in the art from the foregoing disclosure. For example, the entire structure (through use of the strap means or second securement means 24) could be moved relatively downward so as to occupy a horizontal position relatively adjacent zone 114 as illustrated on present FIG. 1. In such instance, the strap means would be secured tightly enough so as to relatively hold covered foam body 12 in the desired location. Those of ordinary skill in the art will appreciate that such features of the present invention are equally applicable to a typical chaise lounge whenever the back 16 thereof is in a more horizontal position rather than the relatively vertical position illustrated in present FIG. 1. In such instances, a user may choose to assume a prone position with the supplemental support being applied to the user's chest or a supine position with the supplemental support being supplied to the user's back.

It should be further understood by those of ordinary skill in the art that the foregoing presently preferred embodiments are exemplary only, and that the attendant description thereof is likewise by way of words of example rather than words of limitation, and their use do not preclude inclusion of such modifications, variations, and/or additions to the present invention which would be readily apparent to one of ordinary skill in the art, the scope of the present invention being set forth in the appended claims.

What is claimed is:

1. A padded removable foam pillow for adjustably supplementing user support on a chaise lounge or similar primary support, comprising:

a substantially rectangular main body comprised of an integral foam layer with substantially planar surfaces, and having a thickness substantially in a range from 0.5 to 2 inches, a width substantially in a range from 6 to 12 inches, a length substantially in a range from 18 to 26 inches, and a density substantially in a range from 1 to 3 pounds per cubic foot;

a fabric covering received about said main body so as to substantially encase same;

first securement means including a fabric member secured to said main body for selectively removably supporting said main body on the top of a chaise lounge back; and respective second securement means, separate from said first securement means and including a strap attached at generally opposite longitudinal ends of said main body, for selectively removably supporting said main body at a selected region of a chaise lounge back, so that a user may select between said respective first and second securement means so as to adjustably supplement user support as desired;

wherein said substantially rectangular main body has four respective edge regions about its periphery; and said first securement means fabric member is secured to said main body generally along three edge regions turned relatively upwardly during use thereof and is unsecured along the fourth edge region turned relatively downwardly during use thereof, so as to form an opening into which the top of a chaise lounge back may be received; and further wherein said first securement means further includes a relatively upturned pouch into which objects may be received whenever said foam pillow is used on a chaise lounge or similar primary support, said upturned pouch of said first securement means comprising a folded integral fabric piece extension of said fabric member secured by stitching to said fabric covering and to an opposing pair of edge regions of said three edge regions of said main body, so as to project respective openings of said fabric member and said pouch towards opposite longitudinal edge regions of said main body.

2. A padded removable foam pillow as in claim 1, wherein at least one of said substantially planar surfaces includes contours which are not generally flat.

3. A padded removable foam pillow as in claim 2, wherein said at least one substantially planar surface of said main body includes convolutions therein.

4. A padded removable foam pillows as in claim 1, wherein said strap comprises a two-piece strap with free ends which may be selectively secured to one another and positioned at a user selected height thereon so as to adjust the supplemental user support of said foam pillow.

5. A padded removable foam pillow as in claim 1, wherein said strap comprises a one-piece elastic strap which may be selectively secured about the back of a chaise lounge and positioned at a user selected height thereon so as to adjust the supplemental user support of said foam pillow.

6. A padded removable foam pillow as in claim 1, further including edging secured with stitching about said three edge regions of said main body, including securement thereof to said fabric member and said folded integral fabric piece extension thereof.

7. A padded removable foam pillow as in claim 1, wherein said main body is substantially rounded at selected respective edge regions thereof.

8. A padded removable foam pillow as in claim 1, wherein said fabric covering includes terry cloth material on at least one side of said main body.

9. A padded removable foam pillow as in claim 1, wherein said fabric covering fully encloses said main body, and comprises washable material.

* * * * *